US008901407B2

(12) United States Patent
Touyama et al.

(10) Patent No.: US 8,901,407 B2
(45) Date of Patent: Dec. 2, 2014

(54) MUSIC SECTION DETECTING APPARATUS AND METHOD, PROGRAM, RECORDING MEDIUM, AND MUSIC SIGNAL DETECTING APPARATUS

(75) Inventors: Keisuke Touyama, Tokyo (JP); Mototsugu Abe, Kanagawa (JP)

(73) Assignee: Sony Corporation, Tokyo (JP)

( * ) Notice: Subject to any disclaimer, the term of this patent is extended or adjusted under 35 U.S.C. 154(b) by 297 days.

(21) Appl. No.: 13/443,047

(22) Filed: Apr. 10, 2012

(65) Prior Publication Data

US 2012/0266742 A1 Oct. 25, 2012

(30) Foreign Application Priority Data

Apr. 19, 2011 (JP) ..... 2011-093441

(51) Int. Cl.

*G10H 7/00* (2006.01)
*G10L 99/00* (2013.01)
*G10H 1/00* (2006.01)

(52) U.S. Cl.

CPC ..... *G10H 1/0008* (2013.01); *G10H 2250/031* (2013.01); *G10L 99/00* (2013.01); *G10H 2210/066* (2013.01); *G10H 2210/046* (2013.01)
USPC ..... 84/616

(58) Field of Classification Search

USPC ..... 84/616
See application file for complete search history.

(56) References Cited

U.S. PATENT DOCUMENTS

| | | | | |
|---|---|---|---|---|
| 7,478,045 | B2 * | 1/2009 | Allamanche et al. | 704/236 |
| 7,930,173 | B2 * | 4/2011 | Fujii | 704/222 |
| 8,412,340 | B2 * | 4/2013 | Litvak et al. | 607/55 |
| 2009/0264960 | A1 * | 10/2009 | Litvak et al. | 607/57 |
| 2012/0266743 | A1 * | 10/2012 | Shibuya et al. | 84/659 |
| 2013/0197606 | A1 * | 8/2013 | Litvak et al. | 607/57 |

FOREIGN PATENT DOCUMENTS

JP 10-301594 11/1998

* cited by examiner

*Primary Examiner* — Jeffrey Donels
(74) *Attorney, Agent, or Firm* — Sherr & Jiang, PLLC

(57) ABSTRACT

An index calculating unit calculates a tonality index of a signal component of each area of an input signal transformed into a time frequency domain based on intensity (for example, power spectrum) of the signal component and a function (quadratic function) obtained by approximating the intensity of the signal component. A music determining unit determines whether or not each area of the input signal includes music based on the tonality index. The present technology can be applied to a music section detecting apparatus that detects a music part from an input signal in which music is mixed with noise.

15 Claims, 17 Drawing Sheets

MUSIC SECTION DETECTING APPARATUS AND METHOD, PROGRAM, RECORDING MEDIUM, AND MUSIC SIGNAL DETECTING APPARATUS

BACKGROUND

The present technology relates to a music section detecting apparatus and method, a program, a recording medium, and a music signal detecting apparatus, and more particularly, to a music section detecting apparatus and method, a program, a recording medium, and a music signal detecting apparatus, which are capable of detecting a music part from an input signal.

In the past, a variety of songs (music) have been used in broadcast programs of television broadcast or radio broadcast. Among broadcast programs, there are programs in which music is clearly used as a main part as in a music program, and programs in which music is used as background music (BGM) as in a drama.

For the viewing audience of broadcast programs, there is often a need to reproduce and view, for example, only a music part of a music program.

Further, for broadcasters, there is often a need to pay a copyright fee easily or to refer to editing of a broadcast program by managing used music according to a broadcast program.

When a music database is prepared, this can be implemented using a technique of comparing a voice signal of a broadcast program with a voice signal of the database and searching for music included in the voice signal of the broadcast program. However, when the music database is not prepared or when music included in the voice signal of the broadcast program is not registered to the database, it is difficult to use the above described music search technique. In this case, a user has to listen to a broadcast program and check for the presence, absence or coincidence of music. It takes a lot of time and effort to listen to such a huge amount of broadcast programs.

In this regard, techniques of detecting a section including music from a voice signal of a broadcast program have been proposed.

For example, there is a technique of detecting a music section based on a time section for which a peak lasts in a time direction when an input signal is transformed into a spectrum (for example, see Japanese Patent Application Laid-Open (JP-A) No. 10-301594).

SUMMARY

According to the technique disclosed in JP-A No. 10-301594, a music section can be detected from an input signal including only music at a specific time, such as a voice signal of a music program or an input signal in which music is mixed with a non-music sound (hereinafter referred to as "noise") having a sufficiently lower level than music with a high degree of accuracy.

However, it is difficult to appropriately detect a peak of a spectrum from an input signal in which music is mixed as BGM with noise such as a voice having almost the same level as music as in a drama, and so the accuracy of detecting a music section is likely to be lowered.

Further, there is a technique of excluding influence of a voice (noise) by subtracting a right channel signal of an input signal from a left channel signal (or subtracting a left channel signal from a right channel signal) using a feature that a voice such as dialogue or narration is commonly oriented to the center in a broadcast program. However, it is difficult to apply this technique to a television broadcast, and it is also difficult to apply this technique to an input signal in which music is oriented to the center. In addition, quantization noise by voice compression is generated independently in both left and right channels, and thus in this technique, quantization noise having a low correlation with an original input signal may be included in a subtracted signal.

Furthermore, a peak that is formed to last in a time direction in a spectrum is not limited to one by music, and the peak may be caused by noise, a side lobe, interference, a time varying tone, or the like. For this reason, it is difficult to completely exclude influence of noise other than music from a detection result of a music section based on a peak.

As described above, it has been difficult to detect a music part from an input signal in which music is mixed with noise having almost the same level as the music with a high degree of accuracy.

The present technology is made in light of the foregoing, and it is desirable to detect a music part from an input signal with a high degree of accuracy.

According to an embodiment of the present technology, there is provided a music section detecting apparatus that includes an index calculating unit that calculates a tonality index of a signal component of each area of an input signal transformed into a time frequency domain based on intensity of the signal component and a function obtained by approximating the intensity of the signal component, and a music determining unit that determines whether or not each area of the input signal includes music based on the tonality index.

The index calculating unit may be provided with a maximum point detecting unit that detects a point of maximum intensity of the signal component from the input signal of a predetermined time section, and an approximate processing unit that approximates the intensity of the signal component near the maximum point by a quadratic function. The index calculating unit may calculate the index based on an error between the intensity of the signal component near the maximum point and the quadratic function.

The index calculating unit may adjust the index according to a curvature of the quadratic function.

The index calculating unit may adjust the index according to a frequency of a maximum point of the quadratic function.

The music section detecting apparatus may further include a feature quantity calculating unit that calculates a feature quantity of the input signal corresponding to a predetermined time based on the tonality index of each area of the input signal corresponding to the predetermined time, and the music determining unit may determine that the input signal corresponding to the predetermined time includes music when the feature quantity is larger than a predetermined threshold value.

The feature quantity calculating unit may calculate the feature quantity by integrating the tonality index of each area of the input signal corresponding to the predetermined time in a time direction for each frequency.

The feature quantity calculating unit may calculate the feature quantity by integrating the tonality index of the area in which the tonality index larger than a predetermined threshold value is most continuous in a time direction for each frequency in each area of the input signal corresponding to a predetermined time.

The music section detecting apparatus may further include a filter processing unit that filters the feature quantity in a time direction, and the music determining unit may determine that the input signal corresponding to the predetermined time includes music when the feature quantity filtered in the time direction is larger than a predetermined threshold value.

According to another embodiment of the present technology, there is provided a method of detecting a music section that includes calculating a tonality index of a signal component of each area of an input signal transformed into a time frequency domain based on intensity of the signal component and a function obtained by approximating the intensity of the signal component, and determining whether or not each area of the input signal includes music based on the tonality index.

According to still another embodiment of the present technology, there are provided a program and a program recorded in a recording medium causing a computer to execute a process of calculating a tonality index of a signal component of each area of an input signal transformed into a time frequency domain based on intensity of the signal component and a function obtained by approximating the intensity of the signal component, and determining whether or not each area of the input signal includes music based on the tonality index.

According to yet another embodiment of the present technology, there are provided a music signal detecting apparatus that includes an index calculating unit that calculates a tonality index of a signal component of each area of an input signal transformed into a time frequency domain based on intensity of the signal component and a function obtained by approximating the intensity of the signal component.

According to an embodiment of the present technology, a tonality index of a signal component of each area of an input signal transformed into a time frequency domain is calculated based on intensity of the signal component and a function obtained by approximating the intensity of the signal component, and it is determined whether or not each area of the input signal includes music based on the tonality index.

According to the embodiments of the present technology described above, a music part can be detected from an input signal with a high degree of accuracy.

DETAILED DESCRIPTION OF THE EMBODIMENT(S)

Figure 1:
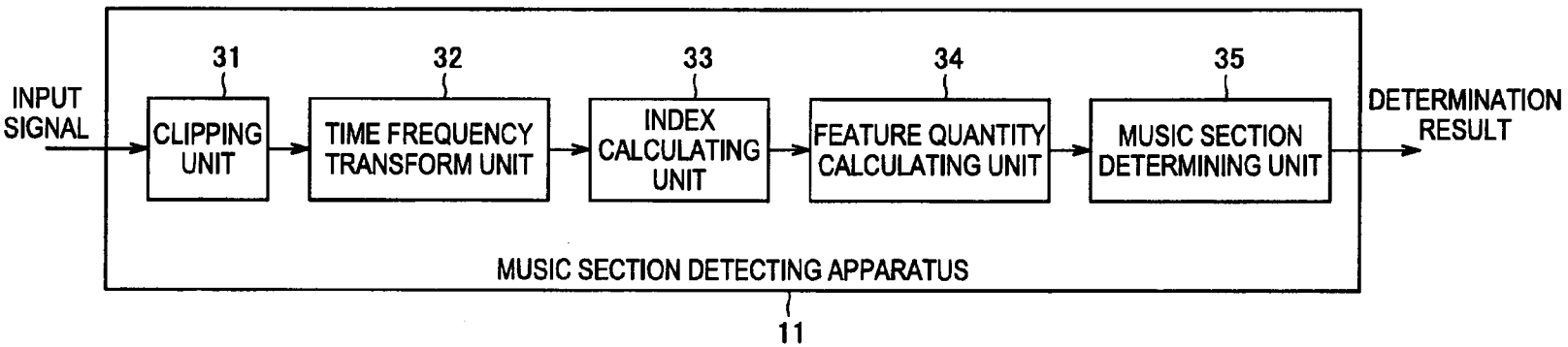
FIG. 1 is a block diagram illustrating a configuration of a music section detecting apparatus according to an embodiment of the present technology.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Hereinafter, embodiments of the present technology will be described with reference to the appended drawings. A description will be made in the following order.

1. Configuration of Music Section Detecting Apparatus
2. Music Section Detecting Process
3. Other Configuration <1. Configuration of Music Section Detecting Apparatus>

FIG. 1 illustrates a configuration of a music section detecting apparatus according to an embodiment of the present technology.

A music section detecting apparatus 11 of FIG. 1 detects a music part from an input signal in which a signal component of music is mixed with a noise component (noise) such as a conversation between people or noise, and outputs a detection result.

The music section detecting apparatus 11 includes a clipping unit 31, a time frequency transform unit 32, an index calculating unit 33, a feature quantity calculating unit 34, and a music section determining unit 35.

The clipping unit 31 clips a signal corresponding to a predetermined time from an input signal, and supplies the clipped signal to the time frequency transform unit 32.

The time frequency transform unit 32 transforms the input signal corresponding to the predetermined time from the clipping unit 31 into a signal (spectrogram) of a time frequency domain, and supplies the spectrogram of the time frequency domain to the index calculating unit 33.

The index calculating unit 33 calculates a tonality index representing a signal component of music based on the spectrogram of the input signal of the time frequency transform unit 32 for each time frequency domain of the spectrogram, and supplies the calculated index to the feature quantity calculating unit 34.

Here, the tonality index represents stability of a tone with respect to a time, which is represented by intensity (for example, power spectrum) of a signal component of each frequency in the input signal. Generally, music has a sound in a certain key (frequency) and continuously sounds and thus is stable in a time direction. However, human conversation has a characteristic in which a tone is unstable in a time direction, and in ambient noise, a tone continuing in a time direction is rarely seen. In this regard, the index calculating unit 33 calculates the tonality index by quantifying the presence or absence of a tone and stability of a tone on the input signal corresponding to a predetermined time section.

The feature quantity calculating unit 34 calculates a feature quantity representing how musical the input signal is (musicality) based on the tonality index of each time frequency domain of the spectrogram from the index calculating unit 33, and supplies the feature quantity to the music section determining unit 35.

The music section determining unit 35 determines whether or not music is included in the input signal corresponding to the predetermined time clipped by the clipping unit 31 based on the feature quantity from the feature quantity calculating unit 34, and outputs the determination result.

[Configuration of Index Calculating Unit]

Next, a detailed configuration of the index calculating unit 33 of FIG. 1 will be described with reference to FIG. 2.

Figure 2:
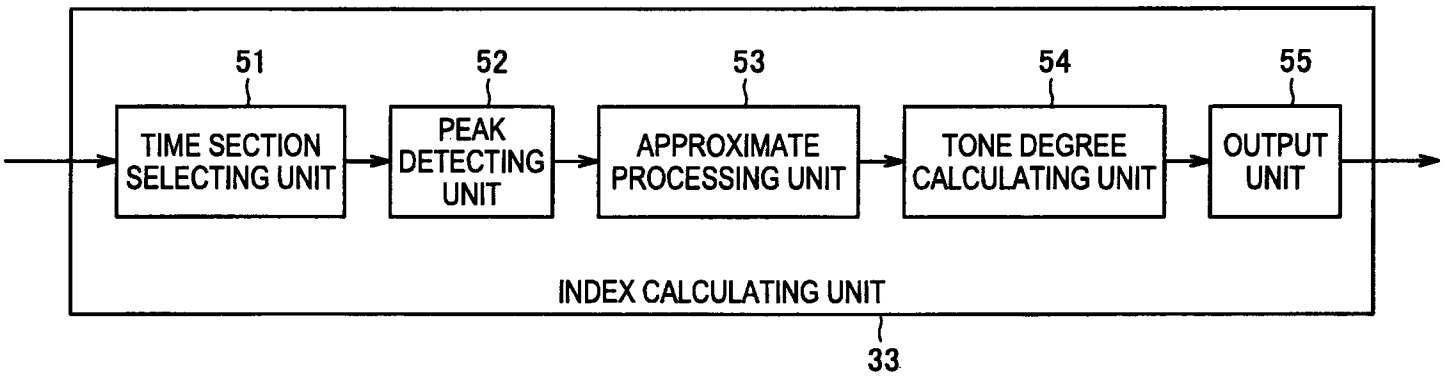
FIG. 2 is a block diagram illustrating a functional configuration example of an index calculating unit.

The index calculating unit 33 of FIG. 2 includes a time section selecting unit 51, a peak detecting unit 52, an approximate processing unit 53, a tone degree calculating unit 54, and an output unit 55.

The time section selecting unit 51 selects a spectrogram of a predetermined time section in the spectrogram of the input signal from the time frequency transform unit 32, and supplies the selected spectrogram to the peak detecting unit 52.

The peak detecting unit 52 detects a peak which is a point at which intensity of the signal component is strongest at each unit frequency in the spectrogram of the predetermined time section selected by the time section selecting unit 51.

The approximate processing unit 53 approximates the intensity (for example, power spectrum) of the signal component around the peak detected by the peak detecting unit 52 in the spectrogram of the predetermined time section by a predetermined function.

The tone degree calculating unit 54 calculates a tone degree obtained by quantifying a tonality index on the spectrogram corresponding to the predetermined time section based on a distance (error) between a predetermined function approximated by the approximate processing unit 53 and a power spectrum around a peak detected by the peak detecting unit 52.

The output unit 55 holds the tone degree on the spectrogram corresponding to the predetermined time section calculated by the tone degree calculating unit 54. The output unit 55 supplies the held tone degrees on the spectrograms of all time sections to the feature quantity calculating unit 34 as the tonality index of the input signal corresponding to the predetermined time clipped by the clipping unit 31.

As described above, the tonality index having the tone degree (element) on the input signal corresponding to the predetermined time clipped by the clipping unit 31 is calculated for each predetermined time section in the time frequency domain and for each unit frequency.

[Configuration of Feature Quantity Calculating Unit]

Next, a detailed configuration of the feature quantity calculating unit 34 illustrated in FIG. 1 will be described with reference to FIG. 3.

Figure 3:
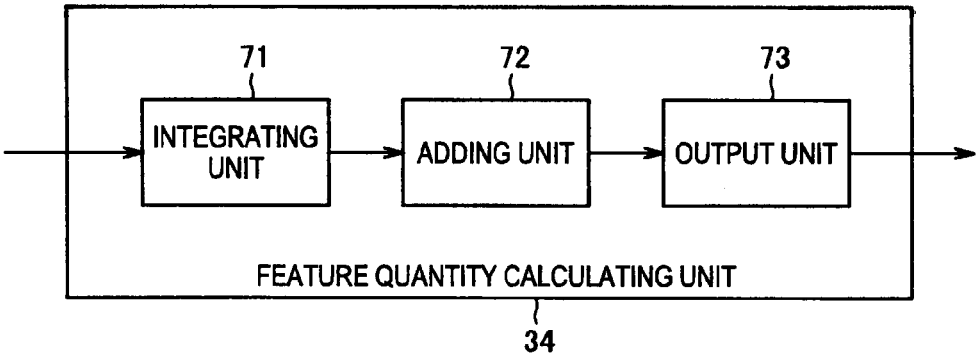
FIG. 3 is a block diagram illustrating a functional configuration example of a feature quantity calculating unit.

The feature quantity calculating unit 34 of FIG. 3 includes an integrating unit 71, an adding unit 72, and an output unit 73.

The integrating unit 71 integrates the tone degrees satisfying a predetermined condition on the tonality index from the index calculating unit 33 for each unit frequency, and supplies the integration result to the adding unit 72.

The adding unit 72 adds an integration value satisfying a predetermined condition to the integration value of the tone degree of each unit frequency from the integrating unit 71, and supplies the addition result to the output unit 73.

The output unit 73 performs a predetermined calculation on the addition value from the adding unit 72, and outputs the calculation result to the music section determining unit 35 as the feature quantity of the input signal corresponding to the predetermined time clipped by the clipping unit 31.

<2. Music Section Detecting Process>

Next, a music section detecting process of the music section detecting apparatus 11 will be described with reference to a flowchart of FIG. 4. The music section detecting process starts when an input signal is input from an external device or the like to the music section detecting apparatus 11. Further, the input signals are input continuously in terms of time to the music section detecting apparatus 11.

The clipping unit 31 clips a signal corresponding to a predetermined time (for example, 2 seconds) from the input signal, and supplies the clipped signal to the time frequency transform unit 32. The clipped input signal corresponding to the predetermined time is hereinafter appropriately referred to as a "block."

In step S12, the time frequency transform unit 32 transforms the input signal (block) corresponding to the predetermined time from the clipping unit 31 into a spectrogram using a window function such as a Harm window or using a discrete Fourier transform (DFT) or the like, and supplies the spectrogram to the index calculating unit 33. Here, the window function is not limited to the Hann function, and a sine window or a Hamming window may be used. Further, the present invention is not limited to a DFT, and a discrete cosine transform (DCT) may be used. Further, the transformed spectrogram may be any one of a power spectrum, an amplitude spectrum, and a logarithmic amplitude spectrum. Further, in order to increase the frequency resolution, a frequency transform length may be increased to be larger than (for example, twice or four times) the length of a window by oversampling by zero-padding.

In step S13, the index calculating unit 33 executes an index calculating process and thus calculates a tonality index of the input signal from the spectrogram of the input signal from the time frequency transform unit 32 in each time frequency domain of the spectrogram.

[Details of Index Calculating Process]

Here, the details of the index calculating process in step S13 of the flowchart of FIG. 4 will be described with reference to a flowchart of FIG. 5.

In step S31, the time section selecting unit 51 of the index calculating unit 33 selects a spectrogram of any one frame in the spectrogram of the input signal from the time frequency transform unit 32, and supplies the selected spectrogram to the peak detecting unit 52. For example, a frame length is 16 msec.

In step S32, the peak detecting unit 52 detects a peak which is a point, in the time frequency domain, at which a power spectrum (intensity) of the signal component on each frequency band is strongest near the frequency band in the spectrogram corresponding to one frame selected by the time section selecting unit 51.

Figure 6:
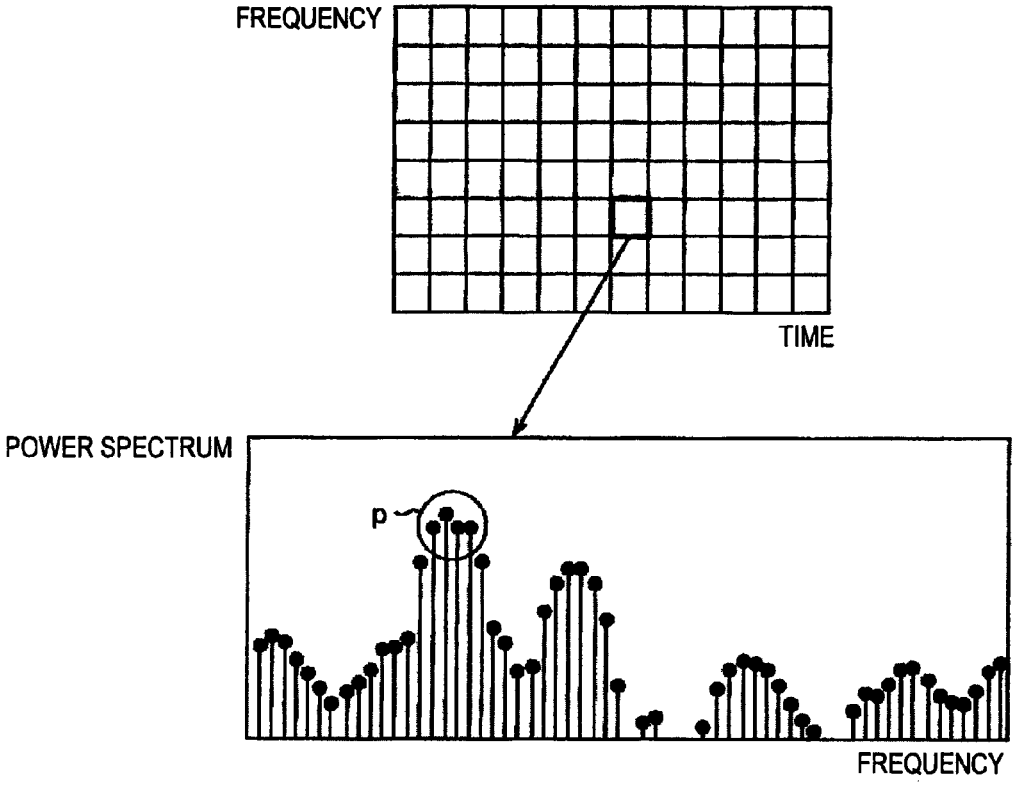
FIG. 6 is a diagram for describing detection of a peak.

For example, in the spectrogram (one quadrangle (square) represents a spectrum of each frequency of each frame) of the input signal, which is transformed into the time frequency domain, illustrated in an upper side of FIG. 6, a peak p (specifically, a maximum spectrum among spectra surrounded by a circle representing a peak p) illustrated in a lower side of FIG. 6 is detected at a certain frequency of a certain frame indicated by a bold square. Actually, the number of squares illustrated in the upper side of FIG. 6 in a longitudinal direction is equal to the number of spectra (the number of black circles) illustrated in the lower side of FIG. 6 in a frequency direction (a horizontal axis direction).

In step S33, the approximate processing unit 53 approximates the power spectrum around the peak detected by the peak detecting unit 52 on the spectrogram corresponding to one frame selected by the time section selecting unit 51 by a quadratic function.

As described above, the peak p is detected in the lower side of FIG. 6, however, the power spectrum that becomes a peak is not limited to a tone (hereinafter referred to as a "persistent tone") that is stable in a time direction. Since the peak may be caused by a signal component such as noise, a side lobe, interference, or a time varying tone, the tonality index may not be appropriately calculated based on the peak. Further, since a DFT peak is discrete, the peak frequency is not necessarily a true peak frequency.

According to a literature J. O. Smith III and X. Serra: "PARSHL: A program for analysis/synthesis of inharmonic sounds based on a sinusoidal representation" in Proc. ICMC'87, a value of a logarithmic amplitude spectrum around a peak in a certain frame can be approximated by a quadratic function regardless of whether it is music or a human voice.

Thus, in the present technology, a logarithmic amplitude spectrum around a peak is approximated by a quadratic function.

Further, in the present technology, it is determined whether or not a peak is caused by a persistent tone under the following assumptions.

a) A persistent tone is approximated by a function obtained by extending a quadratic function in a time direction.

b) A temporal change in frequency is subjected to zero-order approximation (does not change) since a peak by music persists in a time direction.

c) A temporal change in amplitude needs to be permitted to some extent and is approximated, for example, by a quadratic function.

Figure 7:
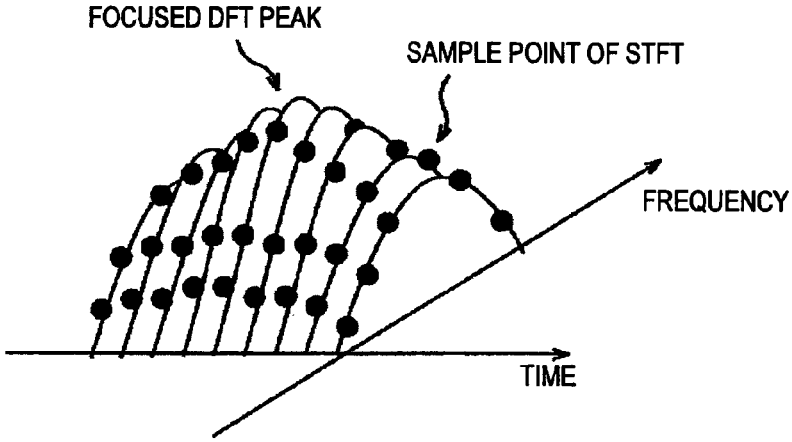
FIG. 7 is a diagram for describing approximation of a power spectrum around a peak.

Thus, a persistent tone is modeled by a tunnel type function (biquadratic function) obtained by extending a quadratic function in a time direction in a certain frame as illustrated in FIG. 7, and can be represented by the following Formula (1) on a time t and a frequency ω. Here, $\omega_p$ represents a peak frequency.

[Math. 1]

$$g(t,\omega)=a(\omega-\omega_p)^2+ct^2+dt+e \tag{1}$$

Thus, an error obtained by applying a biquadratic function, based on the assumptions a) to c), around a focused peak, for example, by least squares approximation, can be used as a tonality (persistent tonality) index. That is, the following Formula (2) can be used as an error function.

[Math. 2]

$$J(a, b, c, d, e) = \sum_{\Gamma} (f(k, n) - g(k, n))^2 \rightarrow \min \tag{2}$$

In Formula (2), f(k,n) represents a DFT spectrum of an n-th frame and a k-th bin, and g(k,n) is a function having the same meaning as Formula (1) representing a model of a persistent tone and is represented by the following Formula (3).

[Math. 3]

$$g(k,n)=ak^2+bk+cn^2+dn+e \tag{3}$$

In Formula (2), Γ represents a time frequency domain around a peak of a target. In the time frequency domain Γ, the size in a frequency direction is decided according to the number of windows used for time-frequency transform not to be larger than the number of sample points of a main lobe decided by a frequency transform length. Further, the size in a time direction is decided according to a time length necessary for defining a persistent tone.

Referring back to FIG. 5, in step S34, the tone degree calculating unit 54 calculates a tone degree, which is a tonality index, on the spectrogram corresponding to one frame selected by the time section selecting unit 51 based on an error between the quadratic function approximated by the approximate processing unit 53 and the power spectrum around a peak detected by the peak detecting unit 52, that is, the error function of Formula (2).

Here, an error function obtained by applying the error function of Formula (2) to a plane model is represented by the following Formula (4), and at this time a tone degree η can be represented by the following Formula (5).

[Math. 4]

$$J'(e') = \sum_{\Gamma} (f(k, n) - e')^2 \rightarrow \min \tag{4}$$

[Math. 5]

$$\eta(k, n) = 1 - \sqrt{J(\hat{a}, \hat{b}, \hat{c}, \hat{d}, \hat{e}) / J'(\hat{e}')} \tag{5}$$

In Formula (5), a hat (a character in which "^" is attached to "a" is referred to as "a hat," and in this disclosure, similar representation is used), b hat, c hat, d hat, and e hat are a, b, c, d, and e for which J(a, b, c, d, e) is minimized, respectively, and e' hat is e' for which J(e') is minimized.

In this way, the tone degree η is calculated.

Meanwhile, in Formula (5), a hat represents a peak curvature of a curved line (quadratic function) of a model representing a persistent tone.

When the signal component of the input signal is a sine wave, theoretically the peak curvature is an integer decided by the type and the size of a window function used for time-frequency transform. Thus, as a value of an actually obtained peak curvature a hat deviates from a theoretical value, a possibility that the signal component is a persistent tone is considered to be lowered. Further, even if the peak has a side lobe characteristic, since the obtained peak curvature is changed, it can be said that deviation of the peak curvature a hat affects the tonality index. In other words, by adjusting the tone degree η according to a value deviating from the theoretical value of the peak curvature a hat, a more appropriate tonality index can be obtained. A tone degree η' adjusted according to the value deviating from the theoretical value of the peak curvature a hat is represented by the following Formula (6).

[Math. 6]

$$\eta'(k,n)=D(\hat{a}-a_{ideal})\eta(k,n) \tag{6}$$

In Formula (6), a value $a_{ideal}$, is a theoretical value of a peak curvature decided by the type and the size of a window function used for a time-frequency transform. A function D(x) is an adjustment function having a value illustrated in FIG. 8. According to the function D(x), as a difference between a peak curvature value and a theoretical value increases, the tone degree decreases. In other words, according to Formula (6), the tone degree is zero (0) on an element which is not a peak. The function D(x) is not limited to a function having a shape illustrated in FIG. 8, and any function may be used to the extent that as a difference between a peak curvature value and a theoretical value increases, a tone degree decreases.

As described above, by adjusting the tone degree according to the peak curvature of the curved line (quadratic function), a more appropriate tone degree is obtained.

Meanwhile, a value "−(b hat)/2(a hat)" according to a hat and b hat in Formula (5) represents an offset from a discrete peak frequency to a true peak frequency.

Theoretically, the true peak frequency is at the position of ±0.5 bin from the discrete peak frequency. When an offset value "−(b hat)/2(a hat)" from the discrete peak frequency to the true peak frequency is extremely different from the position of a focused peak, a possibility that matching for calculating the error function of Formula (2) is not correct is high. In other words, since this is considered to affect reliability of the tonality index, by adjusting the tone degree η according to a deviation value of the offset value "−(b hat)/2(a hat)" from the position (peak frequency) kp of the focused peak, a more appropriate tonality index may be obtained. Specifically, in the function D(x) in Formula (6), a term "(a hat)−$a_{ideal}$" may be replaced with "−(b hat)/2(a hat)−kp", and a value obtained by multiplying a left-hand side of Formula (6) by the function D{−(b hat)/2(a hat)−kp} may be used as the adjusted tone degree η'.

The tone degree may be calculated by a technique other than the above described technique.

Specifically, first, an error function of the following Formula (7) obtained by replacing the model g(k,n) representing the persistent tone with a quadratic function "$ak^2+bk+c$" obtained by approximating a time average shape of a power spectrum around a peak in the error function of Formula (2) is given.

[Math. 7]

$$J(a, b, c) = \sum_{\Gamma} (f(k, n) - (ak^2 + bk + c))^2 \rightarrow \min \tag{7}$$

Next, an error function of the following Formula (8) obtained by replacing the model g(k,n) representing the persistent tone with a quadratic function a' "$k^2+b'k+c'$" obtained by approximating power spectrum of an m-th frame of a focused peak in the error function of Formula (2) is given. Here, m represents a frame number of a focused peak.

[Math. 8]

$$J'(a', b', c') = \sum_{\Gamma, n=m} (f(k, n) = (a'k^2 + b'k + c'))^2 \rightarrow \min \tag{8}$$

Here, when a, b, and c for which J(a, b, c) is minimized are referred to as a hat, b hat, and c hat, respectively, in Formula (7) and a', b', and c' for which J(a', b', c') is minimized are referred to as a' hat, b' hat, and c' hat, respectively, in Formula (8), the tone degree η is given by the following Formula (9).

[Math. 9]

$$\eta(k, n) = D_1\left(1 - \frac{\hat{a}}{\hat{a}'}\right) D_2\left\{\left(-\frac{\hat{b}}{2\hat{a}'}\right) - \left(-\frac{\hat{b}'}{2\hat{a}'}\right)\right\} \tag{9}$$

Figure 8:
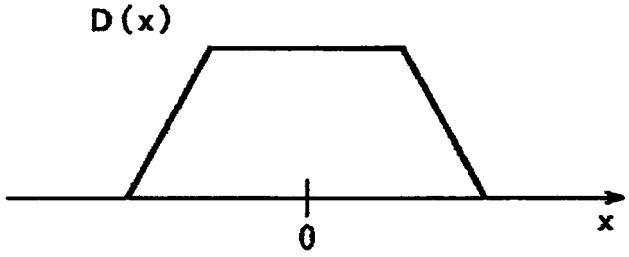
FIG. 8 is a diagram for describing an index adjustment function.

In Formula (9), functions D1(*x*) and D2(*x*) are functions having a value illustrated in FIG. 8. According to Formula (9), on an element that is not a peak, the tone degree η' is zero (0), and when a hat is zero (0) or a' hat is zero (0), the tone degree η' is zero (0).

Further, a non-linear transform may be executed on the tone degree η calculated in the above described way by a sigmoidal function or the like.

Figure 5:
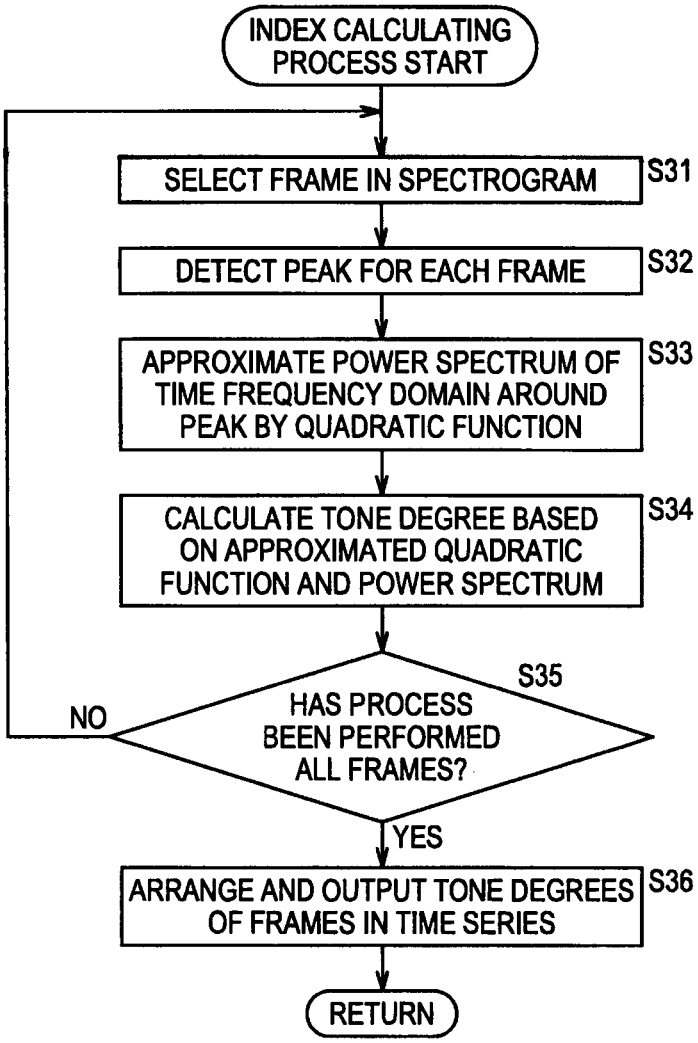
FIG. 5 is a flowchart for describing an index calculating process.

Referring back to the flowchart of FIG. 5, in step S35, the output unit 55 holds the tone degree for the spectrogram corresponding to one frame calculated by the tone degree calculating unit 54, and determines whether or not the above-described process has been performed on all frames in one block.

When it is determined in step S35 that the above-described process has not been performed on all frames, the process returns to step S31, and the processes of steps S31 to S35 are repeated on a spectrogram of a next frame.

However, when it is determined in step S35 that the above-described process has been performed on all frames, the process proceeds to step S36.

In step S36, the output unit 55 arranges the held tone degrees of the respective frames in time series and then supplies (outputs) the tone degrees to the feature quantity calculating unit 34. Then, the process returns to step S13.

Figure 9:
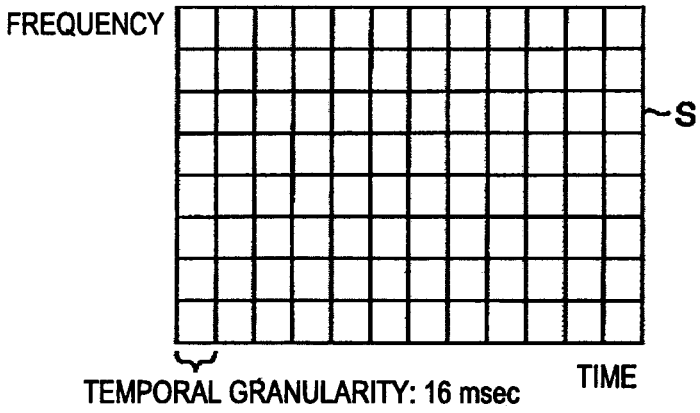
FIG. 9 is a diagram for describing an example of a tonality index of an input signal.

FIG. 9 is a diagram for describing an example of the tonality index calculated by the index calculating unit 33.

As illustrated in FIG. 9, a tonality index S of the input signal calculated from the spectrogram of the input signal has a tone degree as an element (hereinafter referred to as a "component") in a time direction and a frequency direction. Each quadrangle (square) in the tonality index S represents a component at each time (frame) and each frequency and has a value as a tone degree although not shown in FIG. 9. Further, as illustrated in FIG. 9, a temporal granularity (frame length) of the tonality index S is, for example, 16 msec.

As described above, the tonality index on one block of the input signal has a component at each time and each frequency.

Further, the tone degree may not be calculated on an extremely low frequency band since a possibility that a peak by a non-music signal component such as humming noise is included is high. Further, the tone degree may not be calculated, for example, on a high frequency band higher than 8 kHz since a possibility that it is not an important element that configures music is high. Furthermore, even when a value of a power spectrum in a discrete peak frequency is smaller than a predetermined value such as −80 dB, the tone degree may not be calculated.

Figure 4:
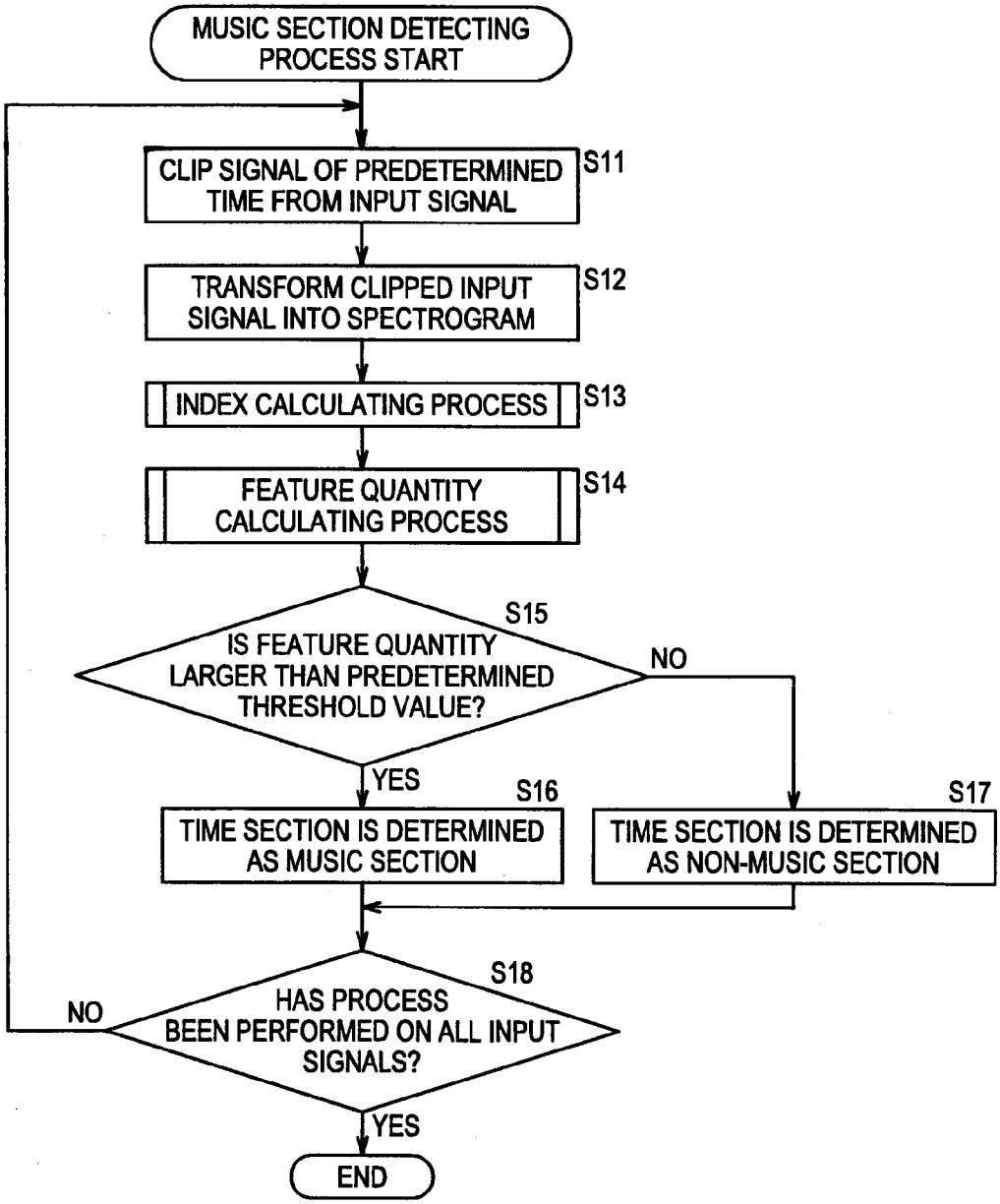
FIG. 4 is a flowchart for describing a music section detecting process.

Returning to the flowchart of FIG. 4, after step S13, in step S14, the feature quantity calculating unit 34 executes a feature quantity calculating process based on the tonality index from the index calculating unit 33 and thus calculates a feature quantity representing musicality of the input signal.

[Details of Feature Quantity Calculating Process]

Here, the details of the feature quantity calculating process in step S14 of the flowchart of FIG. 4 will be described with reference to a flowchart of FIG. 10.

In step S51, the integrating unit 71 integrates tone degrees larger than a predetermined threshold value on the tonality index from the index calculating unit 33 for each frequency, and supplies the integration result to the adding unit 72.

Figure 11:
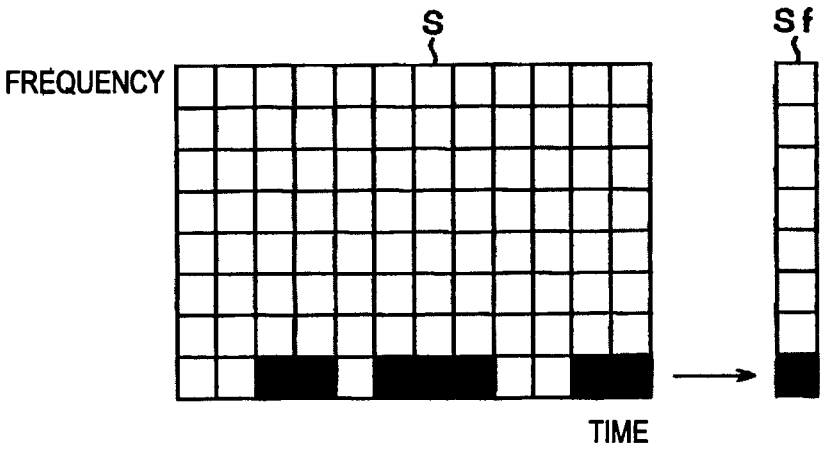
FIG. 11 is a diagram for describing a calculation of a feature quantity.

For example, when a tonality index S illustrated in FIG. 11 is supplied from the index calculating unit 33, the integrating unit 71 has an interest in a tone degree of a lowest frequency (that is, a lowest row in FIG. 11) in the tonality index S. Next, the integrating unit 71 sequentially adds tone degrees, which are indicated by hatching in FIG. 11, larger than a predetermined threshold value among the tone degrees of the frequency of interest (hereinafter referred to as "frequency of interest") in a time direction (a direction from the left to the right in FIG. 11). The predetermined threshold value is appropriately set and may be set, for example, to zero (0). Then, the integrating unit 71 raises the frequency of interest by one, and repeats the above described process on the frequency of interest. In this way, an integration value of the tone degrees is obtained for each frequency of interest. The integration value of the tone degrees has a high value when a frequency includes a music signal component.

Figure 10:
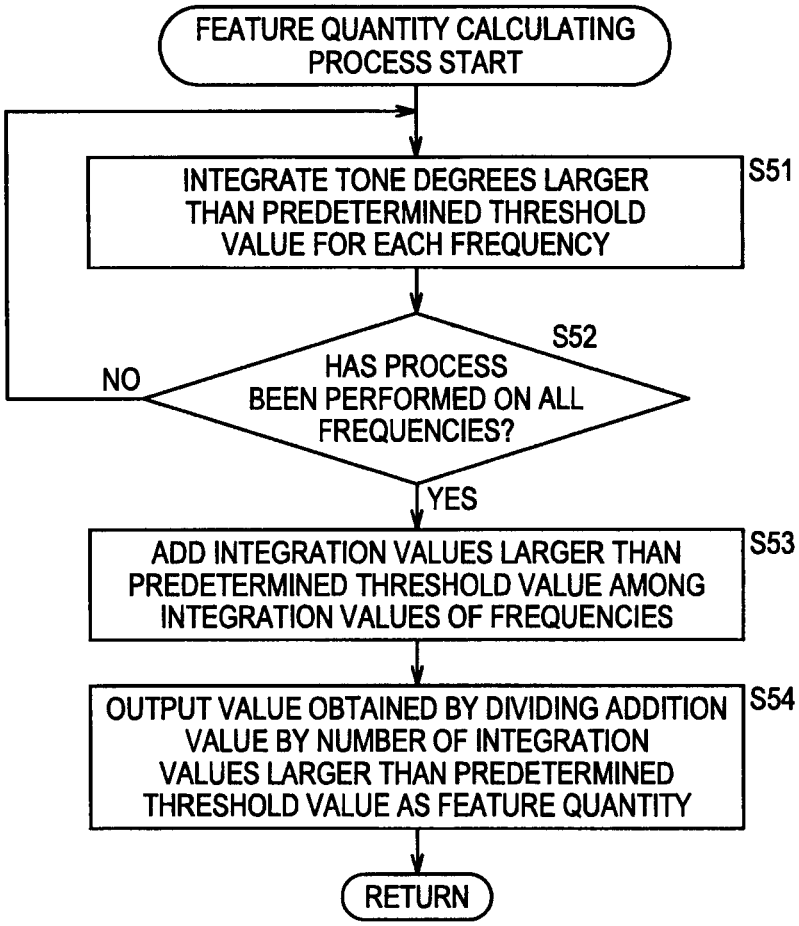
FIG. 10 is a flowchart for describing a feature quantity calculating process.

Returning to the flowchart of FIG. 10, in step S52, the integrating unit 71 determines whether or not the process of integrating the tone degrees for each frequency has been performed on all frequencies.

When it is determined in step S52 that the process has not been performed on all frequencies, the process returns to step S51, and the processes of steps S51 and S52 are repeated.

However, when it is determined in step S52 that the process has been performed on all frequencies, that is, when the integration values are calculated using all frequencies in the tonality index S of FIG. 11 as the frequency of interest, the integrating unit 71 supplies an integration value Sf of the tone degrees of each frequency to the adding unit 72, and the process proceeds to step S53.

In step S53, the adding unit 72 adds the integration values larger than a predetermined threshold value among the integration values of the tone degrees of the respective frequencies from the integrating unit 71, and supplies the addition result to the output unit 73.

Figure 12:
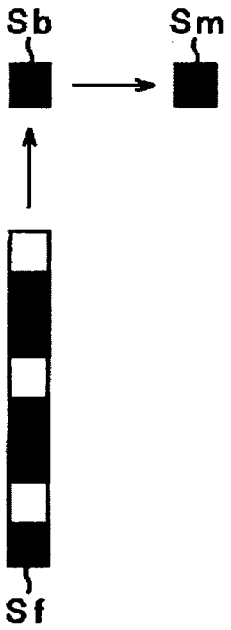
FIG. 12 is a diagram for describing a calculation of a feature quantity.

For example, when the integration value Sf of the tone degrees of each frequency illustrated in FIG. 12 is supplied from the integrating unit 71, the adding unit 72 sequentially adds integration values, which are indicated by hatching in FIG. 12, larger than a predetermined threshold value among the integration values Sf of the tone degrees of the respective frequencies in the frequency direction (a direction from a lower side to an upper side in FIG. 12). The predetermined threshold value is appropriately set and may be set, for example, to zero (0). Then, the adding unit 72 supplies an obtained addition value Sb to the output unit 73. Further, the adding unit 72 counts integration values larger than a predetermined threshold value among the integration values Sf of the tone degrees of the respective frequencies, and supplies the count value (5 in the example of FIG. 12) to the output unit 73 together with the addition value Sb.

In step S54, the output unit 73 supplies a value obtained by dividing an addition value from the adding unit 72 by the count value from the adding unit 72 to the music section determining unit 35 as the feature quantity of the input signal corresponding to one block clipped by the clipping unit 31. In other words, for example, a value Sm obtained by dividing the addition value Sb by the count value 5 is calculated as the feature quantity of the block.

In this way, the feature quantity representing musicality on the block of the input signal is calculated.

Returning to the flowchart of FIG. 4, after step S14, in step S15, the music section determining unit 35 determines whether or not the feature quantity from the feature quantity calculating unit 34 is larger than a predetermined threshold value.

When it is determined in step S15 that the feature quantity is larger than the predetermined threshold value, the process proceeds step S16. In step S16, the music section determining unit 35 determines that a time section of the input signal corresponding to the block clipped by the clipping unit 31 is a music section including music, and outputs information representing this fact.

However, when it is determined in step S15 that the feature quantity is not larger than the predetermined threshold value, the process proceeds to step S17. In step S17, the music section determining unit 35 determines that the time section of the input signal corresponding to the block clipped by the clipping unit 31 is a non-music section including no music, and outputs information representing this fact.

In step S18, the music section detecting apparatus 11 determines whether or not the above process has been performed on all of the input signals (blocks).

When it is determined in step S18 that the above process has not been performed on all of the input signals, that is, when the input signals are consecutively input continuously in terms of time, the process returns to step S11, and step S11 and the subsequent processes are repeated.

However, when it is determined in step S18 that the above process has been performed on all of the input signals, that is, when an input of the input signal has ended, the process also ends.

According to the above described process, the tonality index is calculated from the input signal in which music is mixed with noise, and a section in which music is included in the input signal is detected based on the feature quantity of the input signal obtained from the index. Since the tonality index is one in which stability of a power spectrum with respect to a time is quantified, the feature quantity obtained from the index can reliably represent musicality. Thus, a music part can be detected from the input signal in which music is mixed with noise with a high degree of accuracy.

<3. Other Configuration>

In the above description, the integration value of the tone degrees of each frequency obtained by the feature quantity calculating process has a high value when a frequency includes a music signal component. However, even when tone degrees having a high value are discontinuously included in a certain frequency of interest, an integration value of tone degrees of the frequency of interest has a high value. The tone degree represents tone stability of each frame in the time direction, however, when the tone degrees are high continuously on a plurality of frames, tone stability is more clearly shown.

In this regard, a feature quantity calculating process for evaluating a height of continuous tone degrees on a plurality of frames will be described below.

[Another Configuration of Feature Quantity Calculating Unit]

First, a description will be made in connection with a configuration of a feature quantity calculating unit 34 that performs a feature quantity calculating process for evaluating a height of continuous tone degrees on a plurality of frames.

Figure 13:
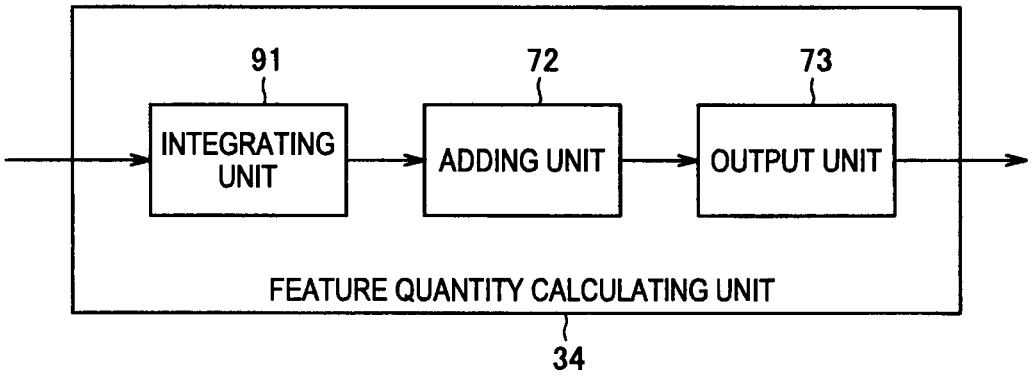
FIG. 13 is a block diagram illustrating another functional configuration example of a feature quantity calculating unit.

In the feature quantity calculating unit 34 of FIG. 13, components having the same function as in the feature quantity calculating unit 34 of FIG. 3 are denoted by the same name and the same reference numerals, and a description thereof will be appropriately omitted.

In other words, the feature quantity calculating unit 34 of FIG. 13 is different from the feature quantity calculating unit 34 of FIG. 3 in that an integrating unit 91 is provided instead of the integrating unit 71.

The integrating unit 91 integrates tone degrees, which are most continuous in terms of time, satisfying a predetermined condition on the tonality index from the index calculating unit 33 for each unit frequency, and supplies the integration result to the adding unit 72.

[Details of Feature Quantity Calculating Process]

Next, the details of the feature quantity calculating process by the feature quantity calculating unit 34 of FIG. 13 will be described with reference to a flowchart of FIG. 14.

Figure 14:
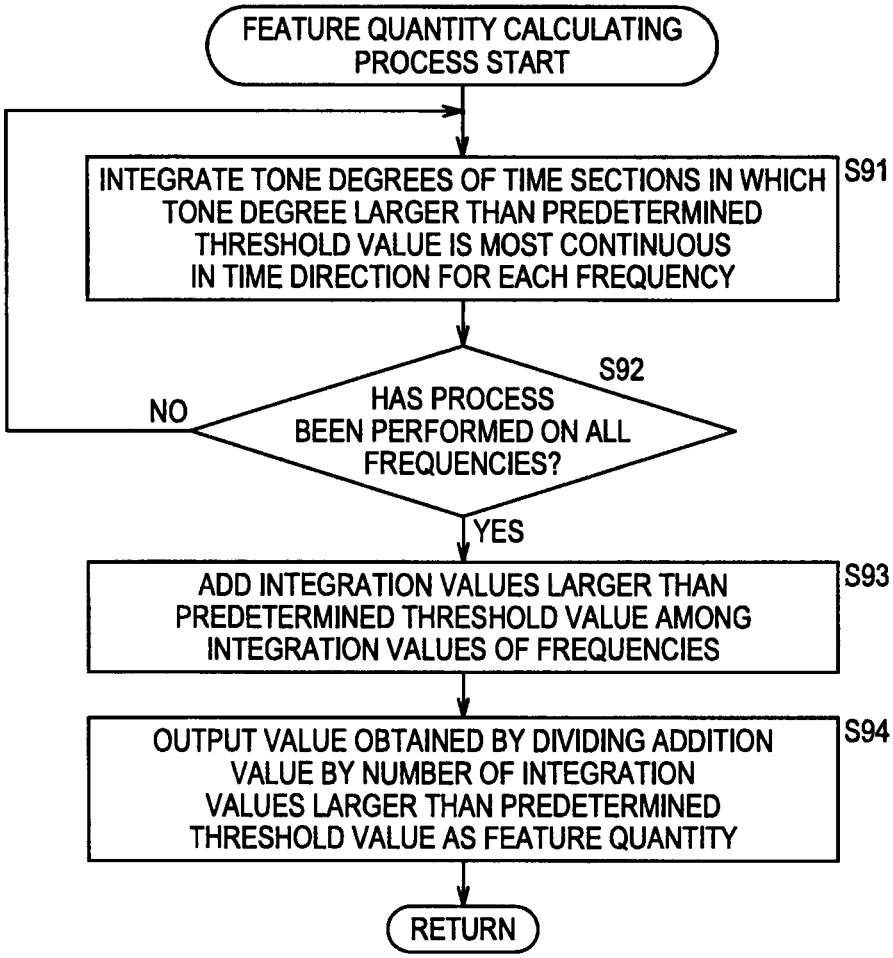
FIG. 14 is a flowchart for describing a feature quantity calculating process.

Processes of steps S92 to S94 of the flowchart of FIG. 14 are basically similarly to the processes of steps S52 to S54 of the flowchart of FIG. 10, and thus a deception thereof will be omitted.

That is, in step S91, the integrating unit 91 integrates tone degrees of a time section in which tone degrees larger than a predetermined threshold value that are most continuous in the time direction based on the tonality index from the index calculating unit 33 for each unit frequency, and supplies the integration result to the adding unit 72.

Figure 15:
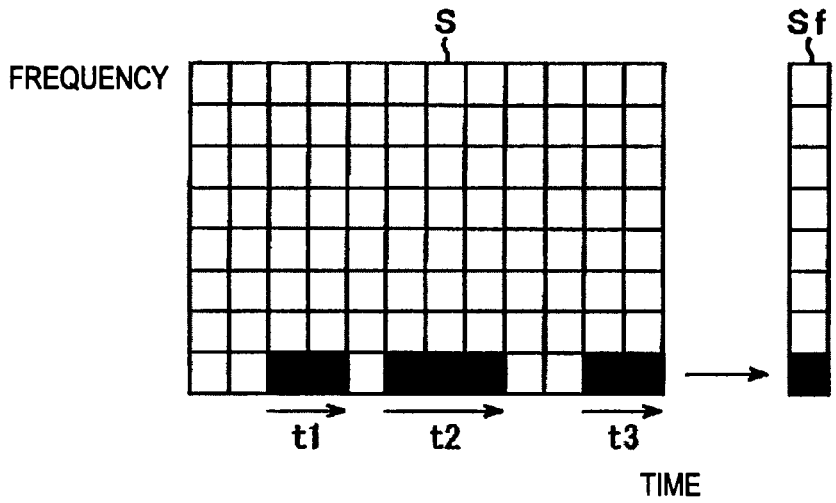
FIG. 15 is a diagram for describing a calculation of a feature quantity.

For example, when a tonality index S illustrated in FIG. 15 is supplied from the index calculating unit 33, the integrating unit 91 first has an interest in tone degrees of a lowest frequency (that is, a lowest row in FIG. 15) in the tonality index S. Next, the integrating unit 91 sequentially adds tone degrees, which are indicated by hatching in FIG. 15, larger than a predetermined threshold value among the tone degrees of the frequency of interest in the time direction (a direction from the left to the right in FIG. 15). At this time, the integrating unit 91 first adds tone degrees of a time section t1 in which tone degrees larger than a predetermined threshold value are continuous in terms of time, and counts the number of tone degrees, i.e., 2. Similarly, the integrating unit 91 adds tone degrees even on a time section t2 and a time section t3, and counts the number thereof, i.e., 3, and 2. Then, the integrating unit 91 uses a value obtained by adding tone degrees of the time section t2 corresponding to the largest number, i.e., 3, among the counted numbers as an integration value of tone degrees of each frequency of interest. The integrating unit 91 repeats the above described process on all frequencies. In this way, an integration value of tone degrees of each frequency of interest is obtained. When a frequency includes a music signal component, the integration value of the tone degrees has a high value, and tone stability is more clearly shown.

Thus, reliability of the feature quantity representing the musicality can be increased, and a music part can be detected from the input signal in which music is mixed with noise with a high degree of accuracy.

As described above, reliability of a music section determination result obtained by a music section detecting process is increased, however, when the feature quantity has a value close to a threshold value, a determination result in which a music section and a non-music section are frequently switched is likely to be obtained. Thus, in the past, by filtering a determination result in which a music section and a non-music section are frequently switched using a median filter or the like, a stable determination result was obtained.

Figure 16:
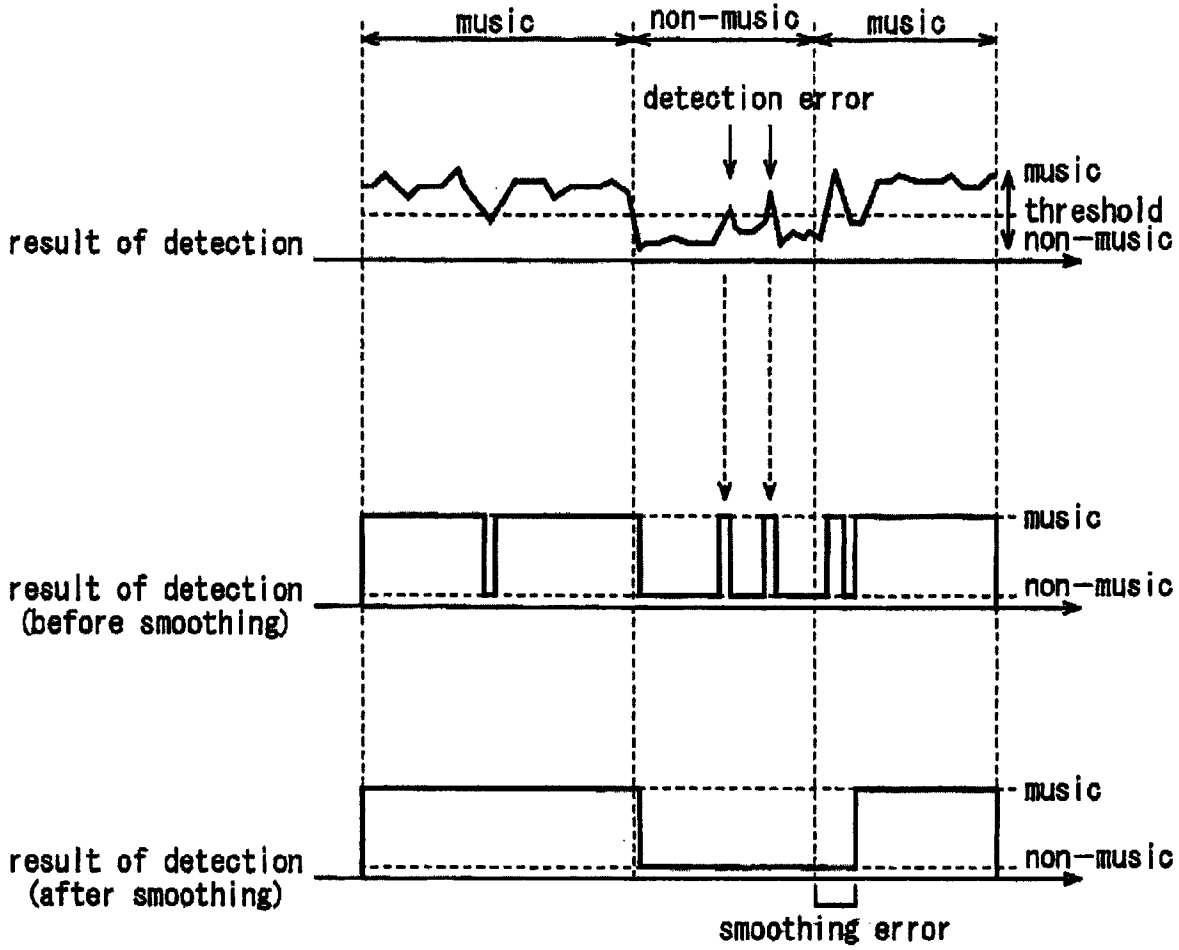
FIG. 16 is a diagram for describing filtering of a determination result by a technique of a related art.

FIG. 16 is a diagram for describing filtering of a determination result by a technique of a related art.

An upper portion of FIG. 16 illustrates a feature quantity of each block in a time direction. The feature quantity has a high value in a music section but has a low value in a non-music section.

A middle portion of FIG. 16 illustrates a music section determination result in which the feature quantity illustrated in the upper portion of FIG. 16 is binarized using a predetermined threshold value. In this determination result, a portion in which a non-music section is erroneously determined as a music section due to a feature quantity calculation error in the non-music section illustrated in FIG. 16 is shown.

A lower portion of FIG. 16 illustrates a result of filtering the determination result illustrated in the middle portion of FIG. 16. As illustrated in the lower portion of FIG. 16, influence of the feature quantity calculation error in the non-music section can be excluded by filtering, however, a part of the music section, at the right side in FIG. 16, adjacent to the non-music section is dealt with as the non-music section by a filtering error.

As described above, it could not be said that reliability of the filtered music section is high.

In this regard, a configuration for increasing reliability of a music section determination result will be described below.

[Another Configuration of Music Section Detecting Apparatus]

Figure 17:
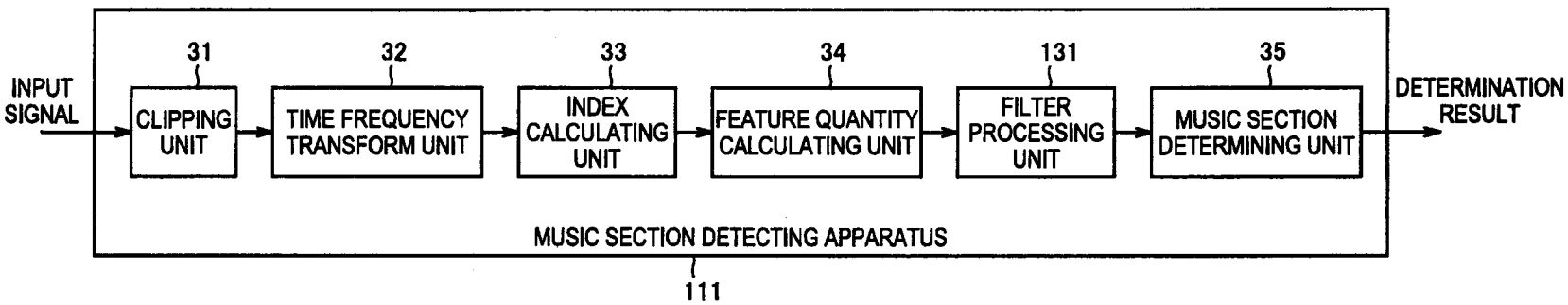
FIG. 17 is a block diagram illustrating another functional configuration example of a music section detecting apparatus.

FIG. 17 illustrates a configuration of a music section detecting apparatus configured to increase reliability of a music section determination result.

In a music section detecting apparatus 111 of FIG. 17, components having the same function as in the music section detecting apparatus 11 of FIG. 1 are denoted by the same names and the same reference numerals, and a description thereof will be appropriately omitted.

That is, the music section detecting apparatus 111 of FIG. 17 is different from the music section detecting apparatus 11 of FIG. 1 in that a filter processing unit 131 is newly arranged between the feature quantity calculating unit 34 and the music section determining unit 35.

The filter processing unit 131 filters the feature quantity from the feature quantity calculating unit 34, and supplies the filtered feature quantity to the music section determining unit 35.

The feature quantity calculating unit 34 in the music section detecting apparatus 111 of FIG. 17 may have the configuration described with reference to FIG. 3 or the configuration described with reference to FIG. 13.

[Details of Music Section Detecting Process]

Next, the details of a music section detecting process performed by the music section detecting apparatus 111 of FIG. 17 will be described with reference to a flowchart of FIG. 18.

Figure 18:
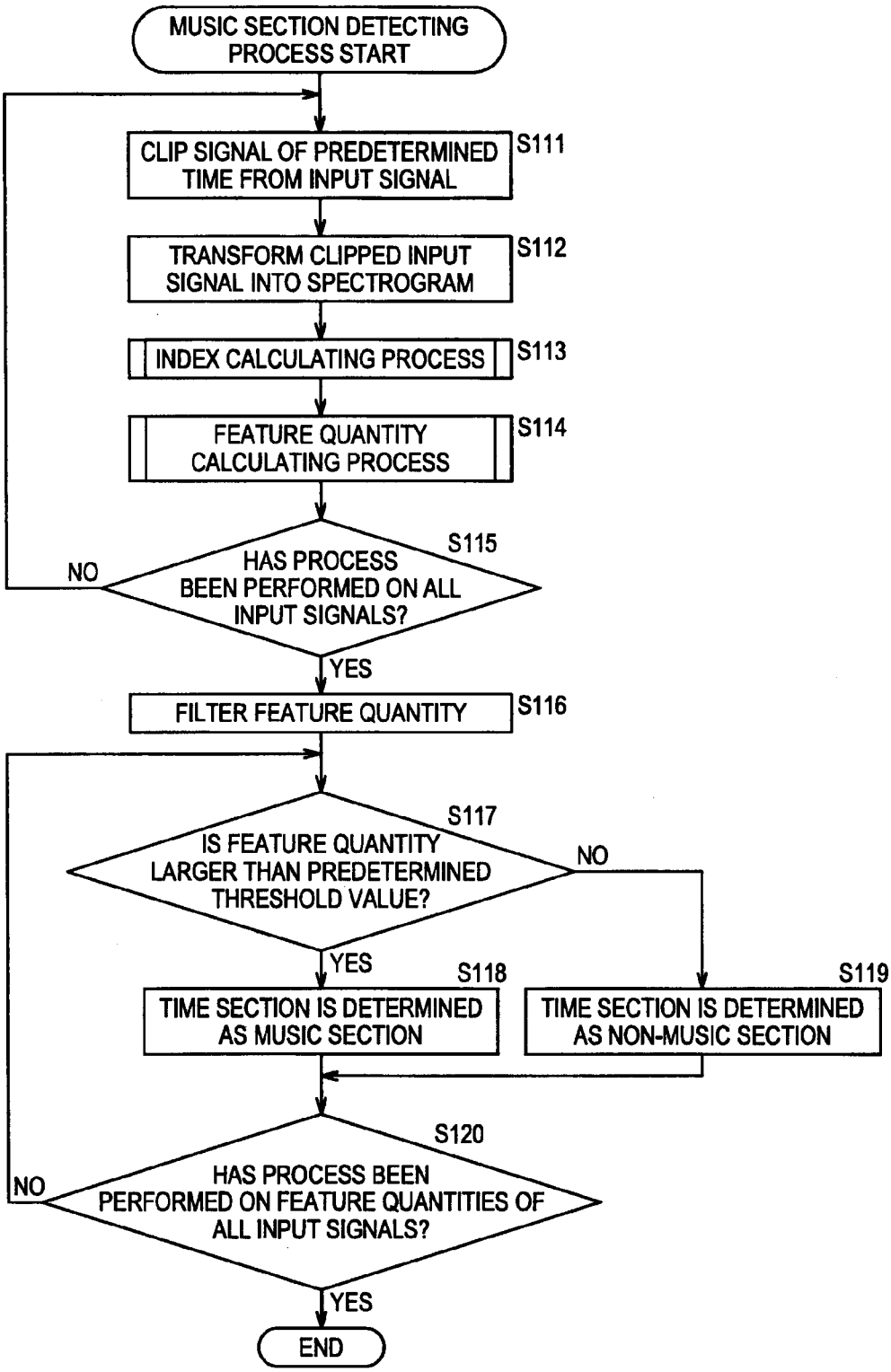
FIG. 18 is a flowchart for describing a music section detecting process.

Processes of steps S111 to S114 of the flowchart of FIG. 18 are basically the same as the processes of steps S11 to S14 of the flowchart of FIG. 4, and thus a description thereof will be omitted. The details of a process in step S115 of the flowchart of FIG. 18 may be described with reference to either the flowchart of FIG. 10 or the flowchart of FIG. 14.

Referring to the flowchart of FIG. 18, in step S114, the feature quantity calculating unit 34 holds the calculated feature quantity for each block.

In step S115, the music section detecting apparatus 111 determines whether or not the processes of steps S111 to S114 have been performed on all of the input signals (blocks).

When it is determined in step S115 that the above processes have not been performed on all of the input signals, that is, when the input signals are continuously input consecutively in terms of time, the process returns to step S111, and the processes of steps S111 to S114 are repeated.

However, when it is determined that the processes have been performed on all of the input signals, that is, when an input of the input signal has ended, the feature quantity calculating unit 34 supplies the feature quantities of all blocks to the filter processing unit 131, and the process proceeds to step S116.

In step S116, the filter processing unit 131 filters the feature quantity from the feature quantity calculating unit 34 using a low pass filter, and supplies a smoothed feature quantity to the music section determining unit 35.

In step S117, the music section determining unit 35 determines whether or not the feature quantity from the feature quantity calculating unit 34 is larger than a predetermined threshold value, sequentially in units of blocks.

When it is determined in step S117 that the feature quantity is larger than the predetermined threshold value, the process proceeds to step S118. In step S118, the music section determining unit 35 determines that a time section of the input signal corresponding to the block is a music section including music, and outputs information representing this fact.

However, when it is determined in step S116 that the feature quantity is not larger than the predetermined threshold value, the process proceeds to step S119. In step S119, the music section determining unit 35 determines that the time section of the input signal corresponding to the block is a non-music section including no music, and outputs information representing this fact.

In step S120, the music section detecting apparatus 111 determines whether or not the above process has been performed on the feature quantities of all of the input signals (blocks).

When it is determined in step S120 that the above process has not been performed on the feature quantities of all of the input signals, the process returns to step S117, and the process is repeated on a feature quantity of a next block.

However, when it is determined that the above process has been performed on the feature quantities of all of the input signals, the process ends.

Figure 19:
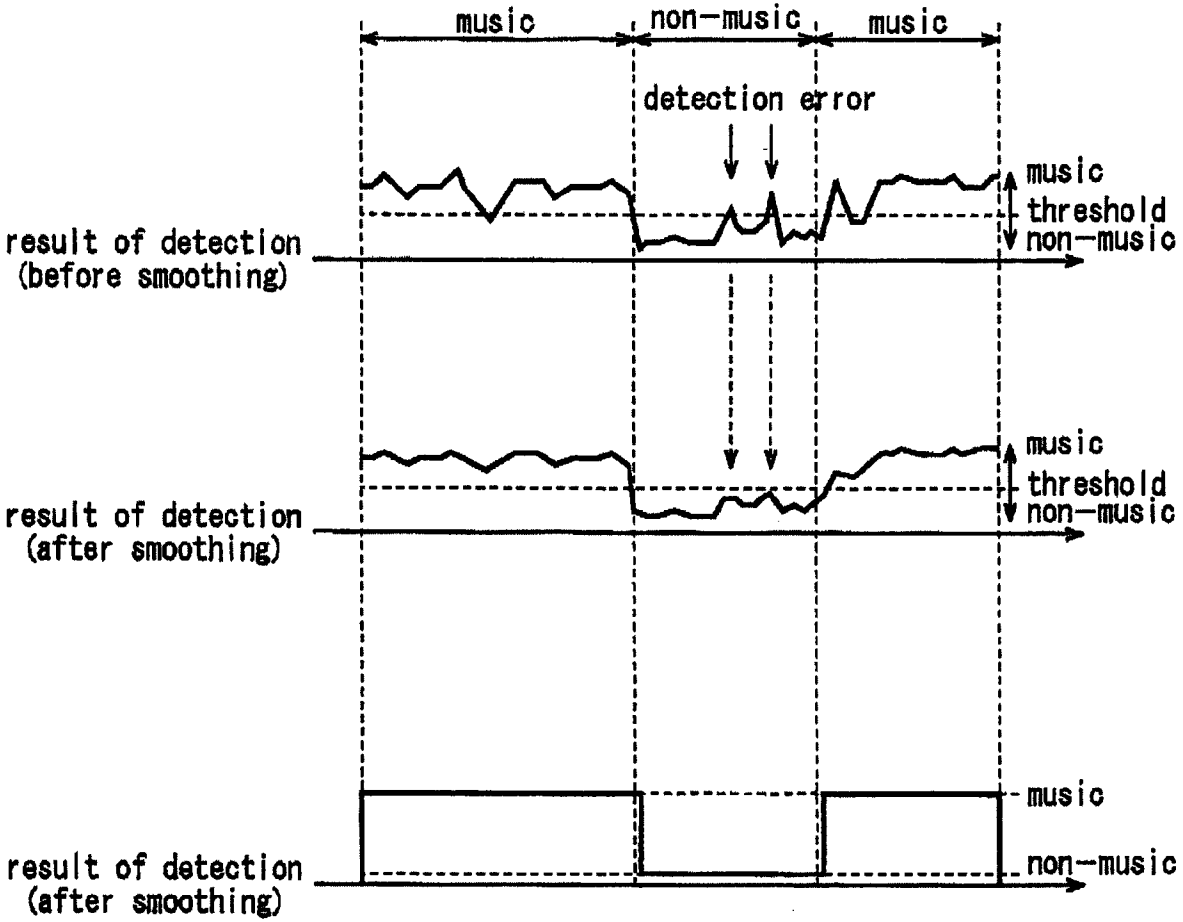
FIG. 19 is a diagram for describing filtering of a feature quantity.

FIG. 19 is a diagram for describing filtering on the feature quantity in the music section detecting process.

An upper portion of FIG. 19 illustrates a feature quantity of each block in a time direction, similarly to the upper portion of FIG. 16.

A middle portion of FIG. 19 illustrates a result of filtering the feature quantity illustrated in the upper portion of FIG. 19. As illustrated in the middle portion of FIG. 19, a feature quantity calculation error in a non-music section illustrated in the upper portion of FIG. 19 is smoothed by filtering.

A lower portion of FIG. 19 illustrates a music section determination result in which the feature quantity illustrated in the middle portion of FIG. 19 is binarized using a predetermined threshold value. In this determination result, a music section and a non-music section are correctly determined.

The feature quantity is calculated based on the tonality index obtained by quantifying stability of a power spectrum with respect to a time and is a value reliably representing musicality. Thus, by filtering the feature quantity as described above, a music section determination result with higher reliability can be obtained.

Further, filtering need not be performed on the feature quantities of all blocks, and a block to be filtered may be selected according to a purpose.

For example, in the music section detecting apparatus 111 of FIG. 17, all input signals may be subjected to a determination on whether or not an input signal is a music section as in the music section detecting process of FIG. 4, and then only a feature quantity of a block determined as a non-music section may be subjected to filtering. In this case, detection omission of a music section is reduced, and thus a recall ratio of a music part can be increased.

The present technology can be applied not only to the music section detecting apparatus 11 illustrated in FIG. 1 but also to a network system in which information is transmitted or received via a network such as the Internet. Specifically, a terminal device such as a mobile telephone may be provided with the clipping unit 31 of FIG. 1, and a server may be provided with the configuration other than the clipping unit 31 of FIG. 1. In this case, the server may perform the music section detecting process on the input signal transmitted from the terminal device via the Internet. Then, the server may transmit the determination result to the terminal device via the Internet. The terminal device may display the determination result received from the server through a display unit or the like.

In the above description, in the music section detecting apparatus 11 (the music section detecting apparatus 111), it is determined whether or not a block is a music section, based on a feature quantity obtained from a tonality index of each block. However, the music section detecting apparatus 11 (the music section detecting apparatus 111) may be provided only with the clipping unit 31 to the index calculating unit 33 and thus function as a music signal detecting apparatus that detects a music signal component in a block.

A series of processes described above may be performed by hardware or software. When a series of processes is performed by software, a program configuring the software is installed in a computer incorporated into dedicated hardware, a general-purpose computer in which various programs can be installed and various functions can be executed, or the like from a program recording medium.

Figure 20:
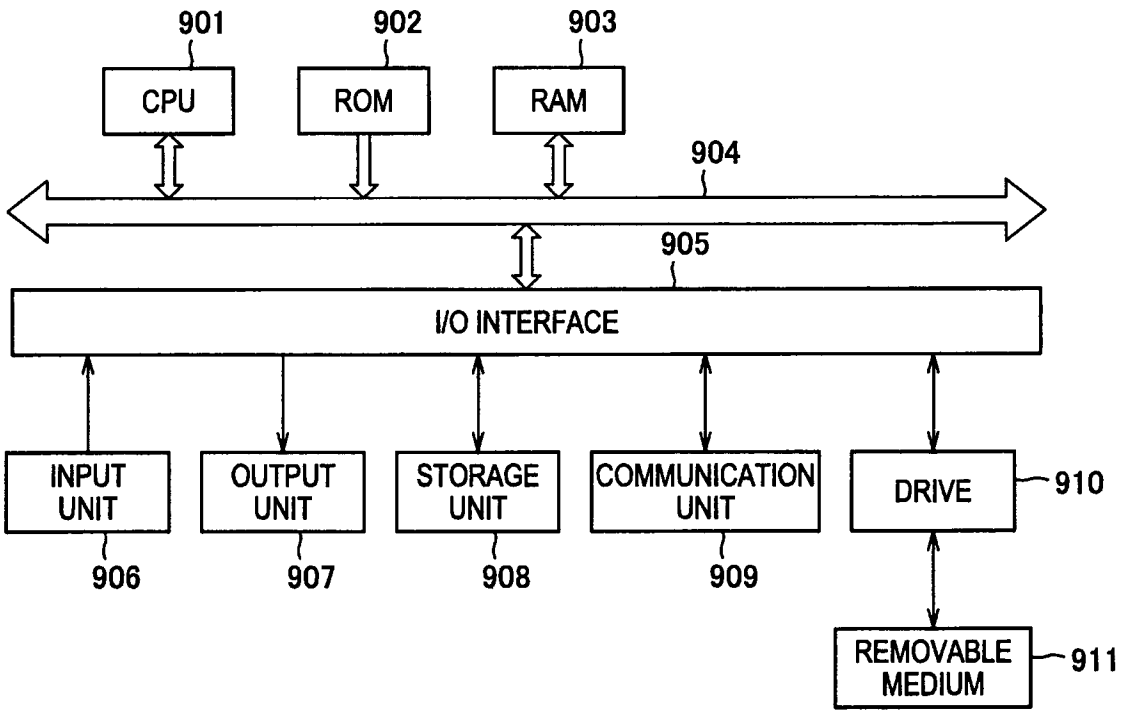
FIG. 20 is a block diagram illustrating a hardware configuration example of a computer.

FIG. 20 is a block diagram illustrating a configuration example of hardware of a computer that executes a series of processes described above by a program.

In the computer, a central processing unit (CPU) 901, a read only memory (ROM) 902, and a random access memory (RAM) 903 are connected to one another via a bus 904.

An input/output (I/O) interface 905 is further connected to the bus 904. The I/O interface 905 is connected to an input unit 906 including a keyboard, a mouse, a microphone, and the like, an output unit 907 including a display, a speaker, and the like, a storage unit 908 including a hard disk, a non-volatile memory, and the like, a communication unit 909 including a network interface and the like, and a drive 910 that drives a removable medium 911 such as magnetic disk, an optical disc, a magnetic optical disc, a semiconductor memory, and the like.

In the computer having the above configuration, the CPU 901 performs a series of processes described above by loading a program stored in the storage unit 908 in the RAM 903 via the I/O interface 905 and the bus 904 and executing the program.

The program executed by the computer (CPU 901) may be recorded in the removable medium 911 which is a package medium including a magnetic disk (including a flexible disk), an optical disc (compact disc (CD)-ROM, a digital versatile disc (DVD), or the like), a magnetic optical disc, a semiconductor memory, or the like. Alternatively, the program may be provided via a wired or wireless transmission medium such as a local area network (LAN), the Internet, or a digital satellite broadcast.

When the removable medium 911 is mounted in the drive 910, the program may be installed in the storage unit 908 via the I/O interface 905. Further, the program may be received by the communication unit 909 via a wired or wireless transmission medium and then installed in the storage unit 908. Additionally, the program may be installed in the ROM 902 or the storage unit 908 in advance.

Further, the program executed by the computer may be a program that causes a process to be performed in time series in the order described in this disclosure or a program that causes a process to be performed in parallel or at necessary timing such as when calling is made.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) A music section detecting apparatus, including:

an index calculating unit that calculates a tonality index of a signal component of each area of an input signal transformed into a time frequency domain based on intensity of the signal component and a function obtained by approximating the intensity of the signal component; and a music determining unit that determines whether or not each area of the input signal includes music based on the tonality index.

(2). The music section detecting apparatus according to (1), wherein the index calculating unit includes:

a maximum point detecting unit that detects a point of maximum intensity of the signal component from the input signal of a predetermined time section; and an approximate processing unit that approximates the intensity of the signal component near the maximum point by a quadratic function, and the index calculating unit calculates the index based on an error between the intensity of the signal component near the maximum point and the quadratic function.

(3) The music section detecting apparatus according to (2), wherein the index calculating unit adjusts the index according to a curvature of the quadratic function.

(4) The music section detecting apparatus according to (2) or (3), wherein the index calculating unit adjusts the index according to a frequency of a maximum point of the quadratic function.

(5) The music section detecting apparatus according to any of (1) to (4), further including a feature quantity calculating unit that calculates a feature quantity of the input signal corresponding to a predetermined time based on the tonality index of each area of the input signal corresponding to the predetermined time, wherein the music determining unit determines that the input signal corresponding to the predetermined time includes music when the feature quantity is larger than a predetermined threshold value.

(6) The music section detecting apparatus according to (5), wherein the feature quantity calculating unit calculates the feature quantity by integrating the tonality index of each area of the input signal corresponding to the predetermined time in a time direction for each frequency.

(7) The music section detecting apparatus according to (5), wherein the feature quantity calculating unit calculates the feature quantity by integrating the tonality index of the area in which the tonality index larger than a predetermined threshold value is most continuous in a time direction for each frequency in each area of the input signal corresponding to the predetermined time.

(8) The music section detecting apparatus according to any of (5) to (7), further including a filter processing unit that filters the feature quantity in a time direction, wherein the music determining unit determines that the input signal corresponding to the predetermined time includes music when the feature quantity filtered in the time direction is larger than a predetermined threshold value.

(9) A method of detecting a music section, including:

calculating a tonality index of a signal component of each area of an input signal transformed into a time frequency domain based on intensity of the signal component and a function obtained by approximating the intensity of the signal component; and determining whether or not each area of the input signal includes music based on the tonality index.

(10) A program causing a computer to execute a process of:

calculating a tonality index of a signal component of each area of an input signal transformed into a time frequency domain based on intensity of the signal component and a function obtained by approximating the intensity of the signal component; and determining whether or not each area of the input signal includes music based on the tonality index.

(11) A recording medium recording the program recited in (10).

(12) A music signal detecting apparatus, including:

an index calculating unit that calculates a tonality index of a signal component of each area of an input signal transformed into a time frequency domain based on intensity of the signal component and a function obtained by approximating the intensity of the signal component.

The present application contains subject matter related to that disclosed in Japanese Priority Patent Application JP 2011-093441 filed in the Japan Patent Office on Apr. 19, 2011, the entire content of which is hereby incorporated by reference.

What is claimed is:

1. A music section detecting apparatus, comprising:

an index calculating unit that calculates a tonality index of a signal component of each area of an input signal transformed into a time frequency domain based on intensity of the signal component and a function obtained by approximating the intensity of the signal component; and a music determining unit that determines whether or not each area of the input signal includes music based on the tonality index, wherein the index calculating unit includes:

a maximum point detecting unit that detects a point of maximum intensity of the signal component from the input signal of a predetermined time section; and an approximate processing unit that approximates the intensity of the signal component near the maximum point by a quadratic function, and the index calculating unit calculates the index based on an error between the intensity of the signal component near the maximum point and the quadratic function.

2. The music section detecting apparatus according to claim 1, wherein the index calculating unit adjusts the index according to a curvature of the quadratic function.

3. The music section detecting apparatus according to claim 1, wherein the index calculating unit adjusts the index according to a frequency of a maximum point of the quadratic function.

4. A music section detecting apparatus, comprising:

an index calculating unit that calculates a tonality index of a signal component of each area of an input signal transformed into a time frequency domain based on intensity of the signal component and a function obtained by approximating the intensity of the signal component;

a music determining unit that determines whether or not each area of the input signal includes music based on the tonality index; and a feature quantity calculating unit that calculates a feature quantity of the input signal corresponding to a predetermined time based on the tonality index of each area of the input signal corresponding to the predetermined time, wherein the music determining unit determines that the input signal corresponding to the predetermined time includes music when the feature quantity is larger than a predetermined threshold value.

5. The music section detecting apparatus according to claim 4, wherein the feature quantity calculating unit calculates the feature quantity by integrating the tonality index of each area of the input signal corresponding to the predetermined time in a time direction for each frequency.

6. The music section detecting apparatus according to claim 4, wherein the feature quantity calculating unit calculates the feature quantity by integrating the tonality index of the area in which the tonality index larger than a predetermined threshold value is most continuous in a time direction for each frequency in each area of the input signal corresponding to the predetermined time.

7. The music section detecting apparatus according to claim 4, further comprising a filter processing unit that filters the feature quantity in a time direction, wherein the music determining unit determines that the input signal corresponding to the predetermined time includes music when the feature quantity filtered in the time direction is larger than a predetermined threshold value.

8. A method of detecting a music section using at least one processor, comprising:

calculating using the at least one processor a tonality index of a signal component of each area of an input signal transformed into a time frequency domain based on intensity of the signal component and a function obtained by approximating the intensity of the signal component; and determining using the at least one processor whether or not each area of the input signal includes music based on the tonality index, wherein the calculating includes:

detecting a point of maximum intensity of the signal component from the input signal of a predetermined time section; and approximating the intensity of the signal component near the maximum point by a quadratic function, and calculating the index based on an error between the intensity of the signal component near the maximum point and the quadratic function.

9. A non-transitory computer-readable medium having embodied thereon a program, which when executed by a processor of computer causes the processor to perform a method, the method comprising:

calculating a tonality index of a signal component of each area of an input signal transformed into a time frequency domain based on intensity of the signal component and a function obtained by approximating the intensity of the signal component; and determining whether or not each area of the input signal includes music based on the tonality index, wherein the calculating includes:

detecting a point of maximum intensity of the signal component from the input signal of a predetermined time section; and approximating the intensity of the signal component near the maximum point by a quadratic function, and calculating the index based on an error between the intensity of the signal component near the maximum point and the quadratic function.

10. A recording medium recording the program recited in claim 9.

11. A music signal detecting apparatus, comprising:

an index calculating unit that calculates a tonality index of a signal component of each area of an input signal transformed into a time frequency domain based on intensity of the signal component and a function obtained by approximating the intensity of the signal component, wherein the index calculating unit includes:

a maximum point detecting unit that detects a point of maximum intensity of the signal component from the input signal of a predetermined time section; and an approximate processing unit that approximates the intensity of the signal component near the maximum point by a quadratic function, and the index calculating unit calculates the index based on an error between the intensity of the signal component near the maximum point and the quadratic function.

12. A method of detecting a music section using at least one processor, comprising:

calculating using the at least one processor a tonality index of a signal component of each area of an input signal transformed into a time frequency domain based on intensity of the signal component and a function obtained by approximating the intensity of the signal component;

determining using the at least one processor whether or not each area of the input signal includes music based on the tonality index;

calculating using the at least one processor a feature quantity of the input signal corresponding to a predetermined time based on the tonality index of each area of the input signal corresponding to the predetermined time; and determining using the at least one processor that the input signal corresponding to the predetermined time includes music when the feature quantity is larger than a predetermined threshold value.

13. A non-transitory computer-readable medium having embodied thereon a program, which when executed by a processor of computer causes the processor to perform a method, the method comprising:

calculating a tonality index of a signal component of each area of an input signal transformed into a time frequency domain based on intensity of the signal component and a function obtained by approximating the intensity of the signal component; and determining whether or not each area of the input signal includes music based on the tonality index;

calculating a feature quantity of the input signal corresponding to a predetermined time based on the tonality index of each area of the input signal corresponding to the predetermined time; and determining that the input signal corresponding to the predetermined time includes music when the feature quantity is larger than a predetermined threshold value.

14. A recording medium recording the program recited in claim 13.

15. A music signal detecting apparatus, comprising:

an index calculating unit that calculates a tonality index of a signal component of each area of an input signal transformed into a time frequency domain based on intensity of the signal component and a function obtained by approximating the intensity of the signal component;

a feature quantity calculating unit that calculates a feature quantity of the input signal corresponding to a predetermined time based on the tonality index of each area of the input signal corresponding to the predetermined time; and a music determining unit that determines that the input signal corresponding to the predetermined time includes music when the feature quantity is larger than a predetermined threshold value.

* * * * *